US008242397B2

(12) United States Patent
Fu

(10) Patent No.: US 8,242,397 B2
(45) Date of Patent: Aug. 14, 2012

(54) ILLUMINATED PUSH SWITCH

(75) Inventor: Chien-Chun Fu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 345 days.

(21) Appl. No.: 12/511,269

(22) Filed: Jul. 29, 2009

(65) Prior Publication Data

US 2010/0282582 A1 Nov. 11, 2010

(30) Foreign Application Priority Data

May 8, 2009 (CN) ..... 2009 1 0302184

(51) Int. Cl.
*H01H 9/00* (2006.01)

(52) U.S. Cl. ..... 200/314

(58) Field of Classification Search ..... 200/314, 200/310
See application file for complete search history.

(56) References Cited

U.S. PATENT DOCUMENTS

| | | | | |
|---|---|---|---|---|
| 7,205,495 | B2 * | 4/2007 | Mazur | 200/316 |
| 2005/0263380 | A1 * | 12/2005 | Bouvier et al. | 200/310 |
| 2006/0191779 | A1 * | 8/2006 | Rochon et al. | 200/314 |

* cited by examiner

*Primary Examiner* — Vanessa Girardi
(74) *Attorney, Agent, or Firm* — Altis Law Group, Inc.

(57) ABSTRACT

A switch apparatus includes a Light Emitting Diode (LED) housing and a light guide pole. The LED housing includes at least one LED light source and a switch. The switch is capable of being actuated to light the at least one LED light source. The light guide pole is capable of transmitting light. The light guide pole is removably embedded in the LED housing to contact with the switch. The light guide pole presses the switch to drive the at least one LED light source to light.

19 Claims, 21 Drawing Sheets

ILLUMINATED PUSH SWITCH

BACKGROUND

1. Technical Field

The present disclosure relates to a switch apparatus and, particularly, to a switch apparatus with Light Emitting Diode.

2. Description of Related Art

Buttons are typically used in electronic devices to control the power to start up an operation of the electronic device. An indication light is usually positioned adjacent to the button to indicate a working state of the electronic device. The indication light and the button are separate parts. It needs a plurality of accessories and occupies large space.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
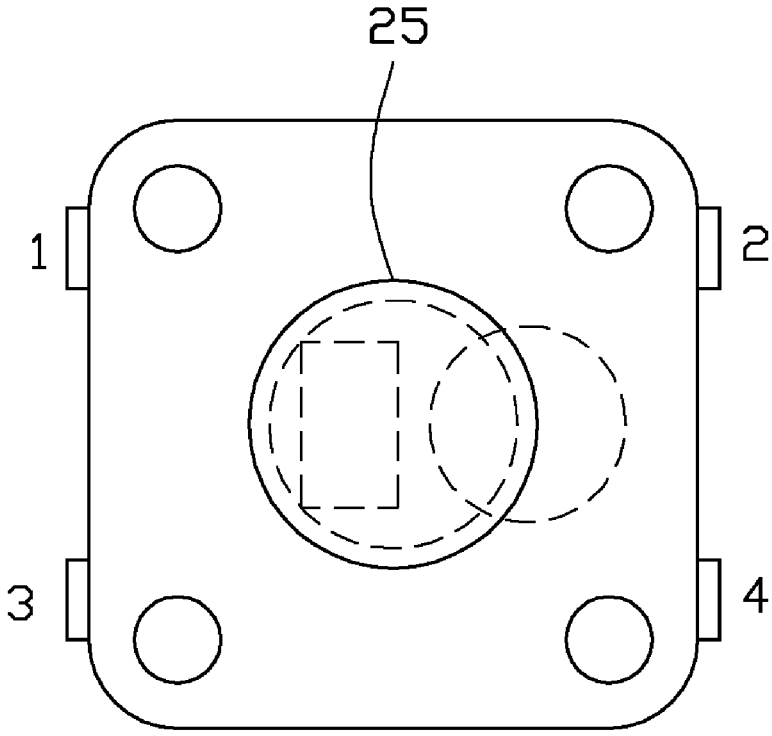
FIGS. 1-3 are schematic views of a first embodiment of a switch apparatus.
Figure 2:
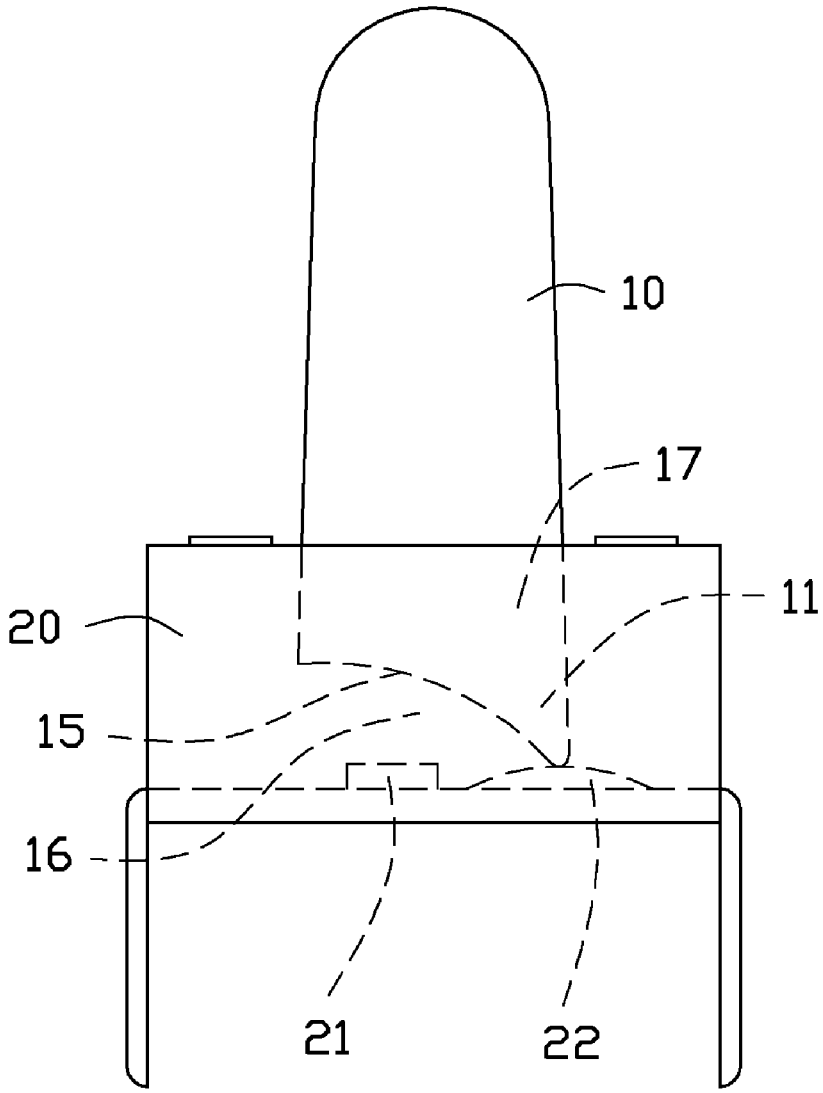
Figure 3:
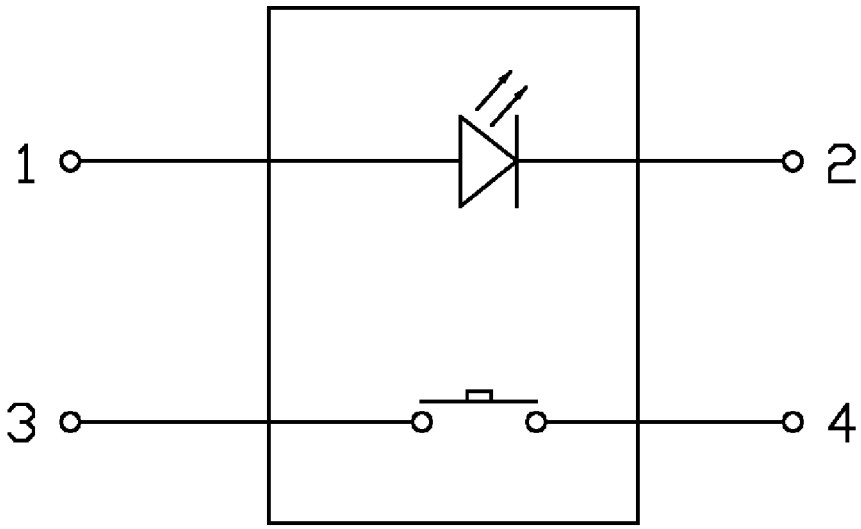

Referring to FIGS. 1-3, a switch apparatus in a first embodiment includes a light guide pole 10 and a Light Emitting Diode (LED) housing 20. The light guide pole 10 is an integral part gradually tapered from a bottom portion 17 inside the LED housing 20 to a top portion 18 outside the LED housing 20. The light guide pole 10 having diameters gradually increase from the top portion 18 outside the LED housing 20 to the bottom portion 17 inside the LED housing 20. An oblique dissymmetric curved edge 15 is defined at an end of the bottom portion 17. A recess 16 is defined under the oblique dissymmetric curved edge 15, and the least one LED light source is located in the recess 16. A pressing portion 11 projects from the bottom portion 17 of the light guide pole 10 at a bottom end of the oblique dissymmetric curved edge 15. The light guide pole 10 is embedded in the LED housing 20. The LED housing 20 includes a LED 21 and a resilient metal piece 22 adjacent to the LED 21. The LED 21 and the metal piece 22 are located under the light guide pole 10. The LED 21 emits light in a single color. The LED housing 20 defines a pole hole 25. The light guide pole 10 has a coniform configuration. The light guide pole 10 extends through the pole hole 25. The light guide pole 10 is movably inserted through the pole hole 25 of the LED housing 20 such that the light guide pole 10 is engaged with the pole hole 25 when the light guide pole 10 abuts the resilient metal piece 22 before the light guide pole 10 presses the resilient metal piece 22 to trigger the LED 21. The LED 21 and the resilient metal piece 22 are substantially located at a same plane extending along a direction substantially perpendicular to a moving direction of the light guide pole 25 relative to the LED housing 20.

The LED housing 20 may be encapsulated by dual in-line package (DIP). In microelectronics, a dual in-line package (DIP), is an electronic device package with a rectangular housing and two parallel rows of electrical connecting pins. The LED housing 20 may be encapsulated by Surface-mount technology (SMT). Surface-mount technology (SMT) is a method for constructing electronic circuits in which the components (SMC, or Surface Mounted Components) are mounted directly onto the surface of printed circuit boards (PCBs).

The LED housing 20 has four pins, pin 1, pin 2, pin 3, and pin 4. The LED light source 21 is connected between the pin 1 and the pin 2. A switch is connected between the pin 3 and the pin 4 to turn on the LED light source 21. The pressing portion 11 resists against the metal piece 22 to light the LED light source 21.

Figure 4:
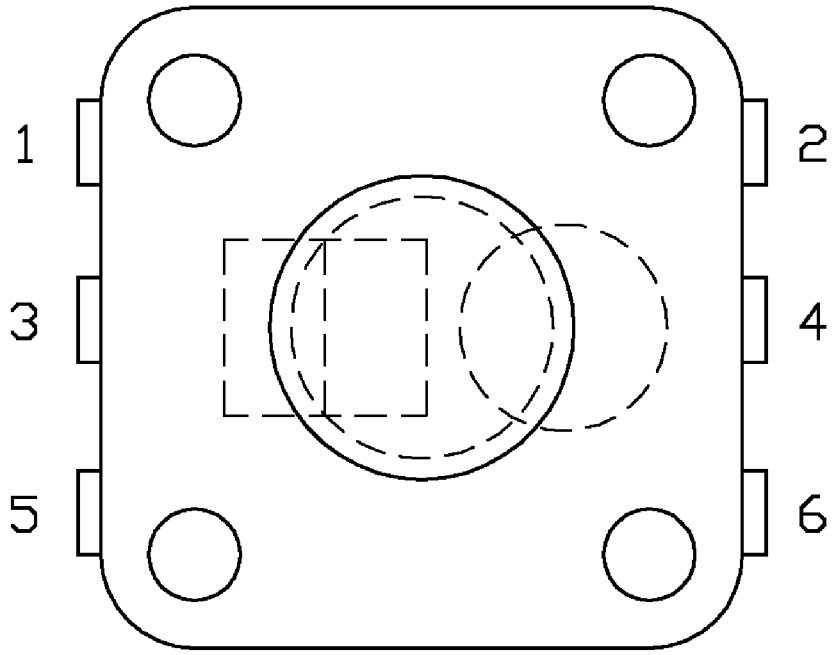
FIGS. 4-6 are schematic views of a second embodiment of the switch apparatus.
Figure 5:
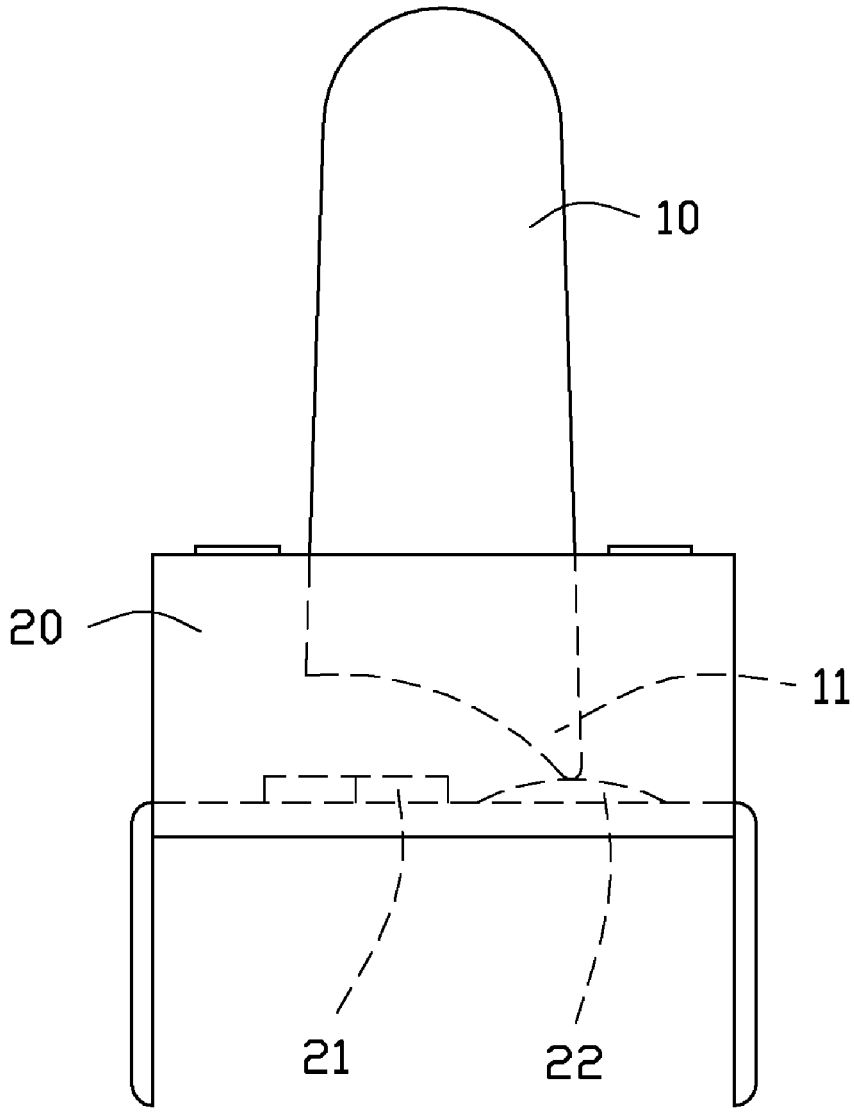
Figure 6:
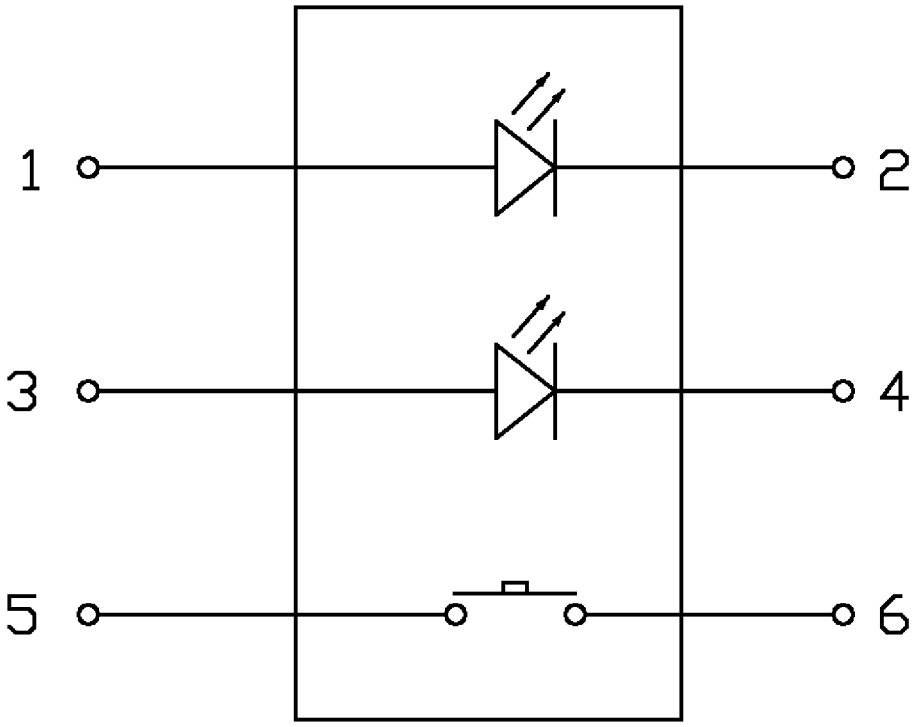

Referring to FIGS. 4-6, a switch apparatus in a second embodiment includes six pins and two parallel LED light sources 21 in the LED housing 20. When a first LED light source is connected between the pin 1 and the pin 2, the first LED light source emits a first light color. When a second LED light source is connected between the pin 3 and the pin 4, the second LED light source emits a second light color. The switch is connected between the pin 5 and the pin 6. The LED light sources 21 can be controlled by Pulse-width modulation (PWM) to emit different light colors.

Figure 7:
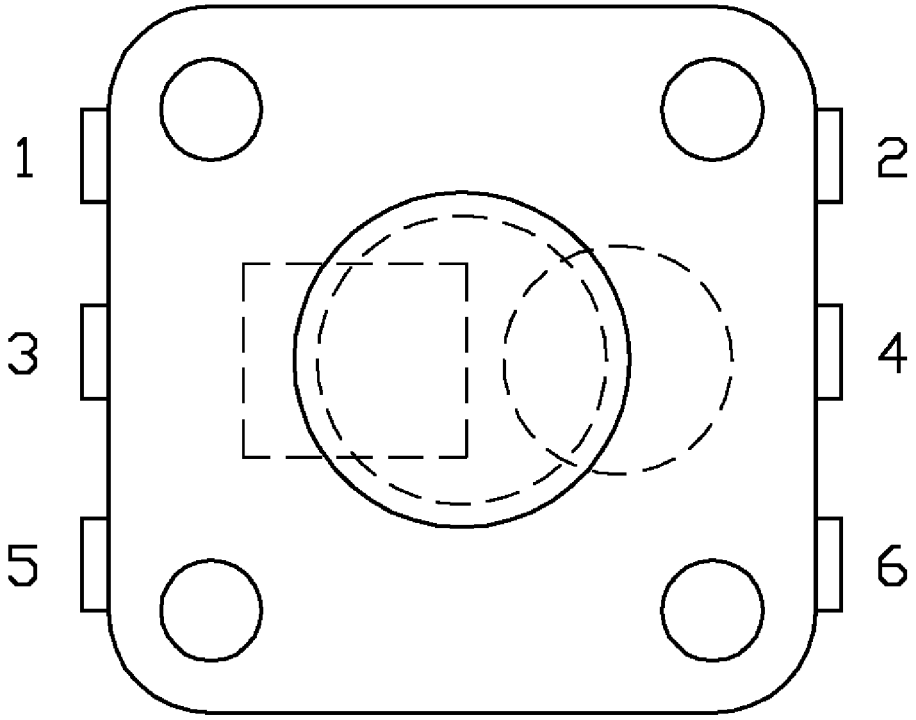
FIGS. 7-9 are schematic views of a third embodiment of the switch apparatus.
Figure 8:
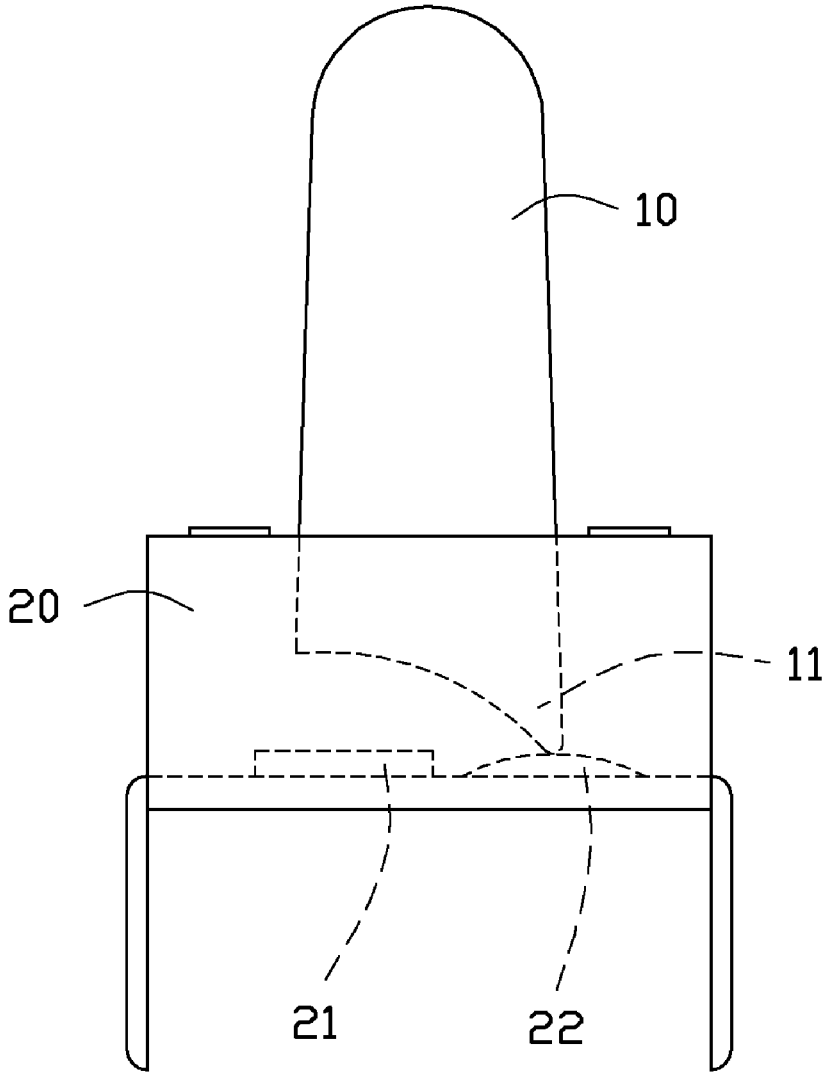
Figure 9:
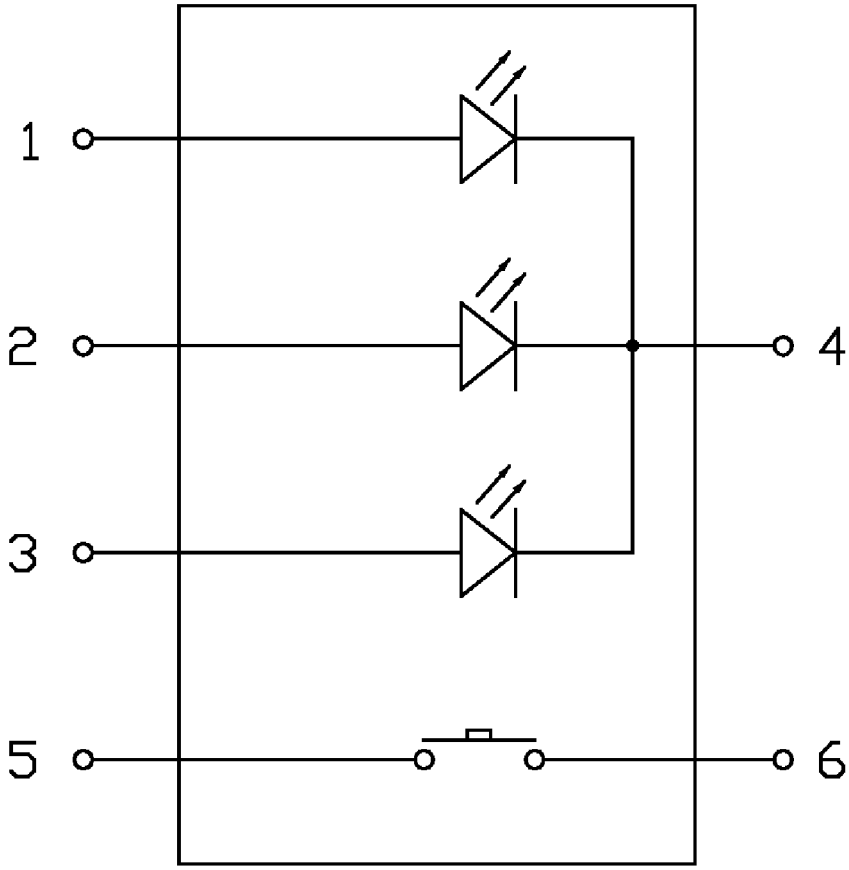
Figure 10:
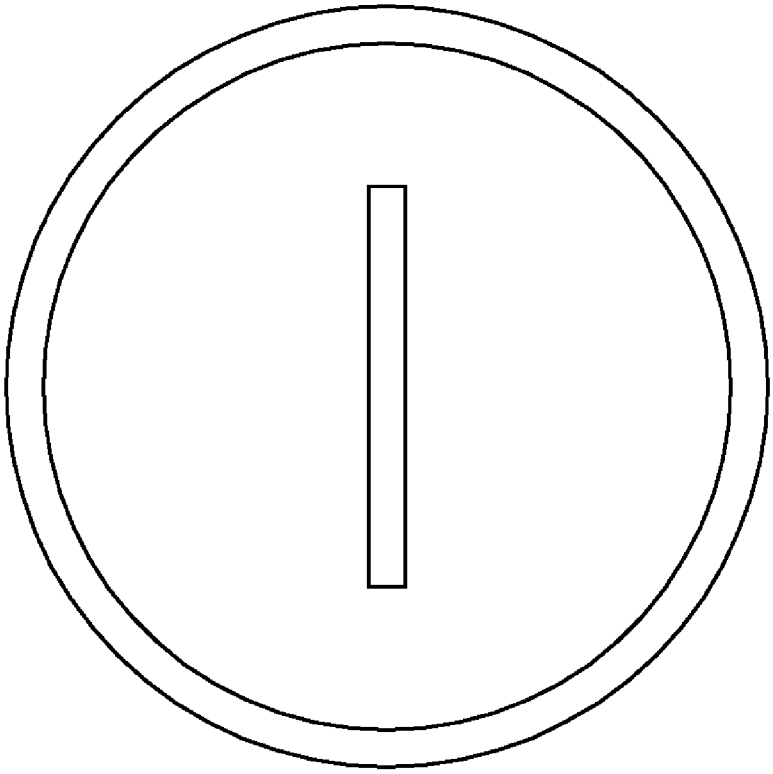
FIGS. 10-14 are schematic views of alternative embodiments of a top portion of a light guide pole of the switch apparatus.
Figure 11:
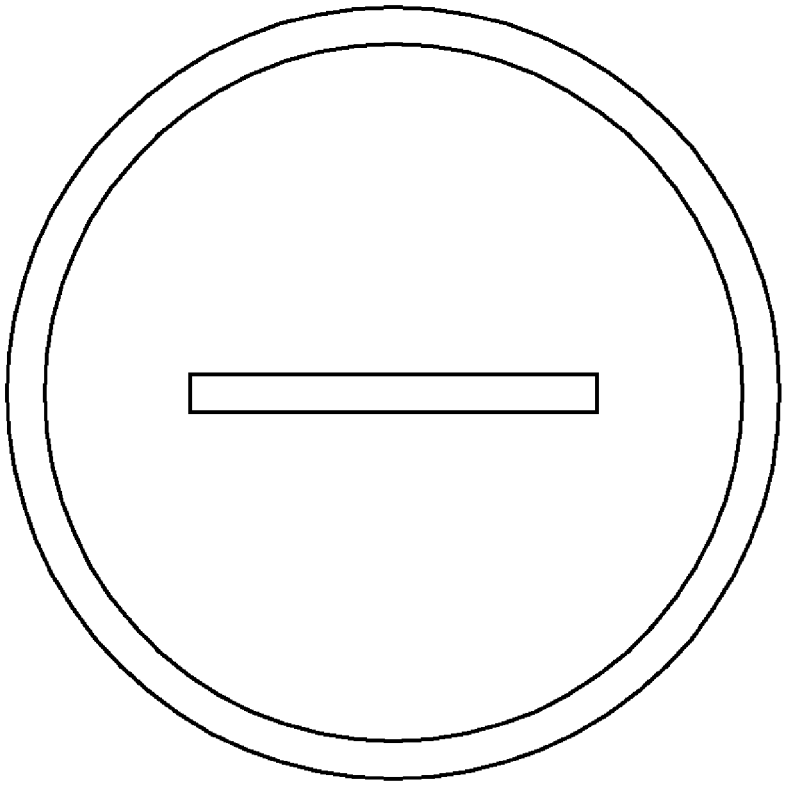
Figure 12:
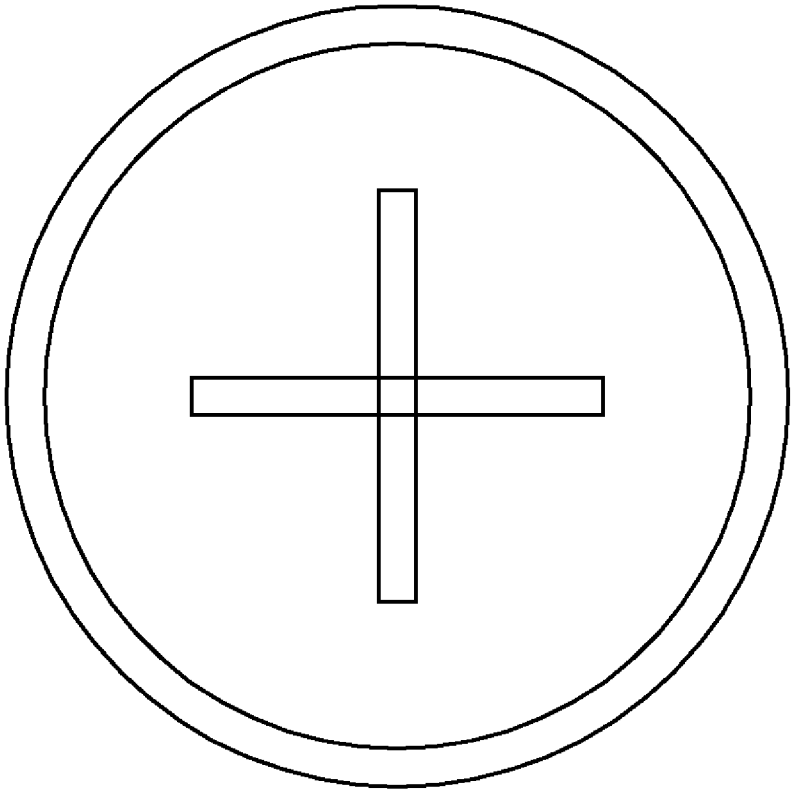
Figure 13:
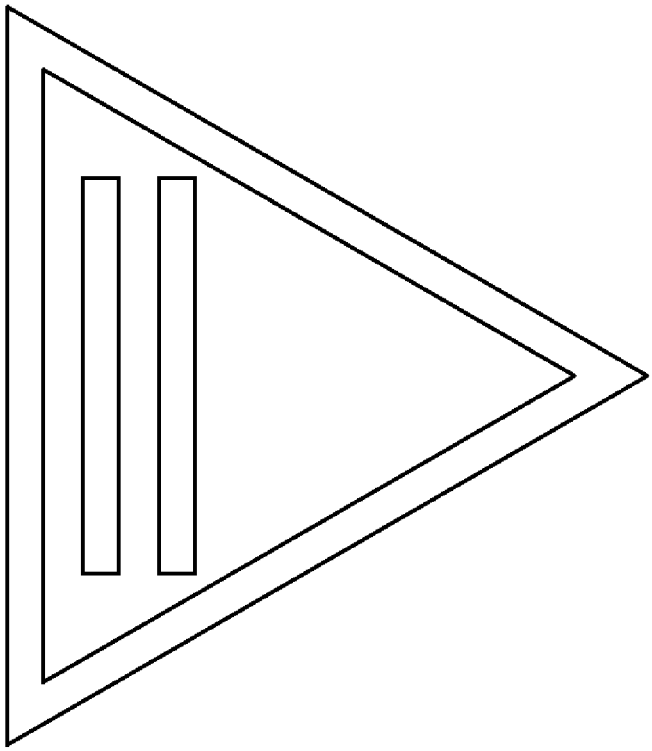
Figure 14:
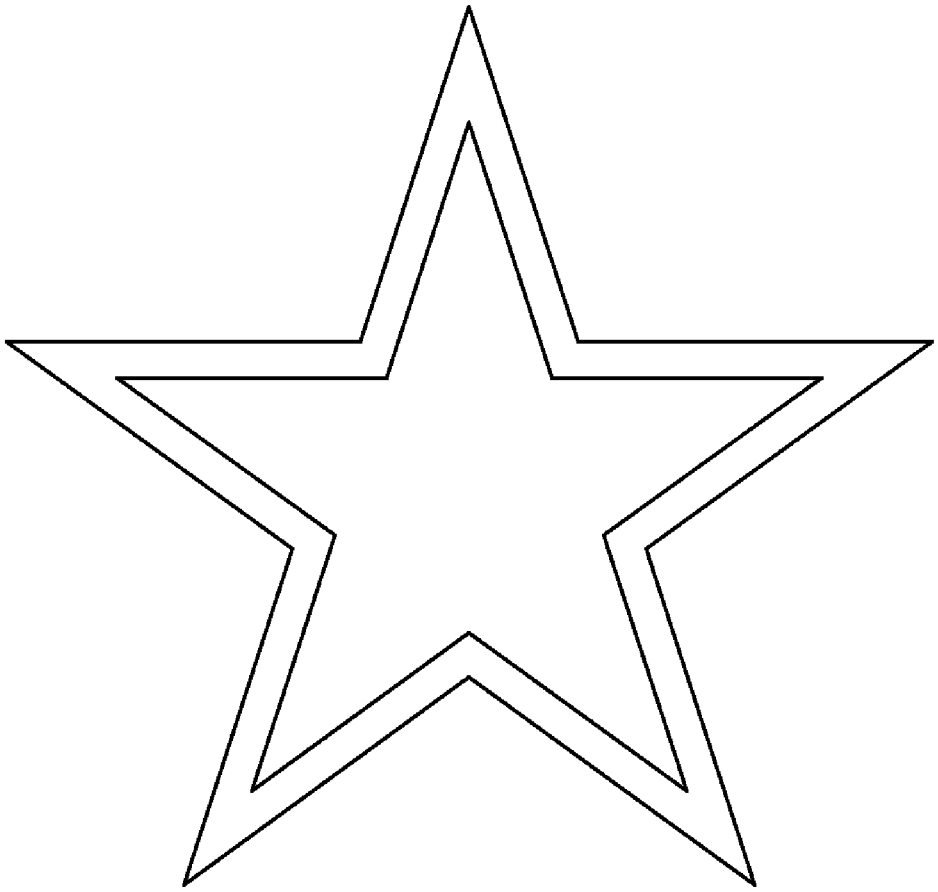
Figure 15:
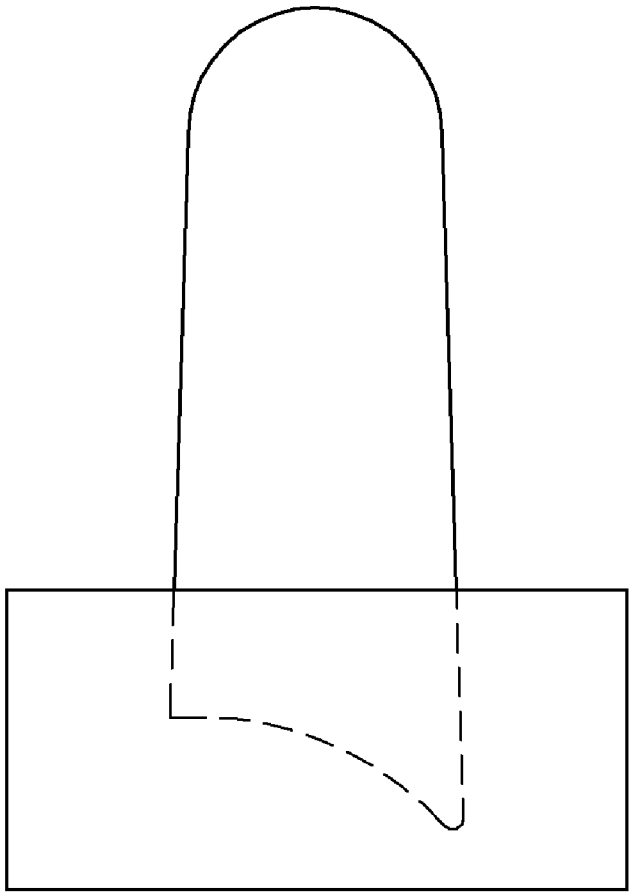
FIGS. 15-21 are schematic views of alternative embodiment of the light guide pole and an LED housing of the switch apparatus.
Figure 16:
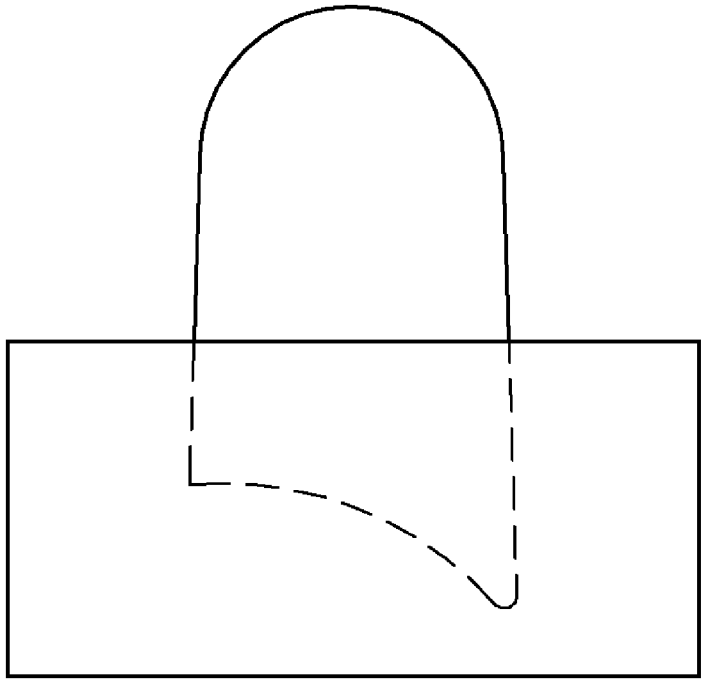
Figure 17:
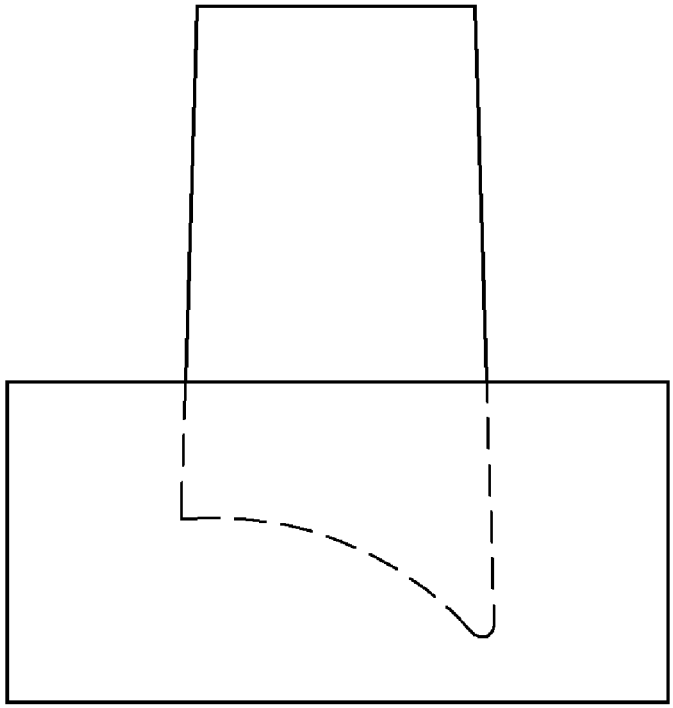
Figure 18:
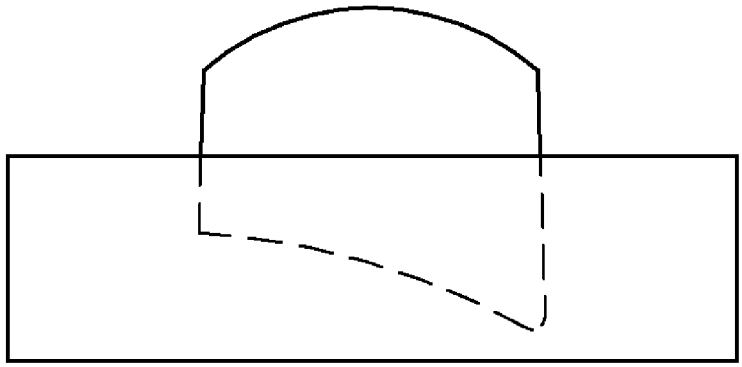
Figure 19:
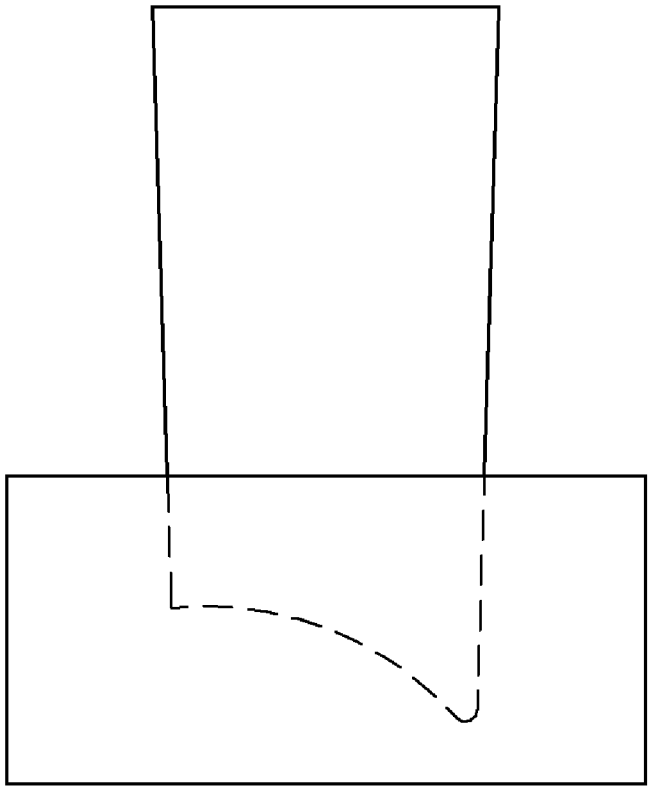
Figure 20:
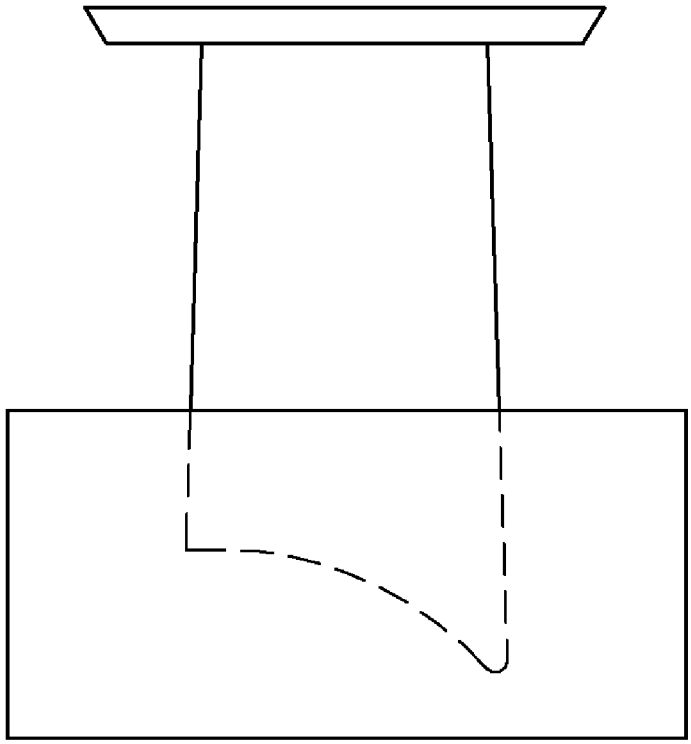
Figure 21:
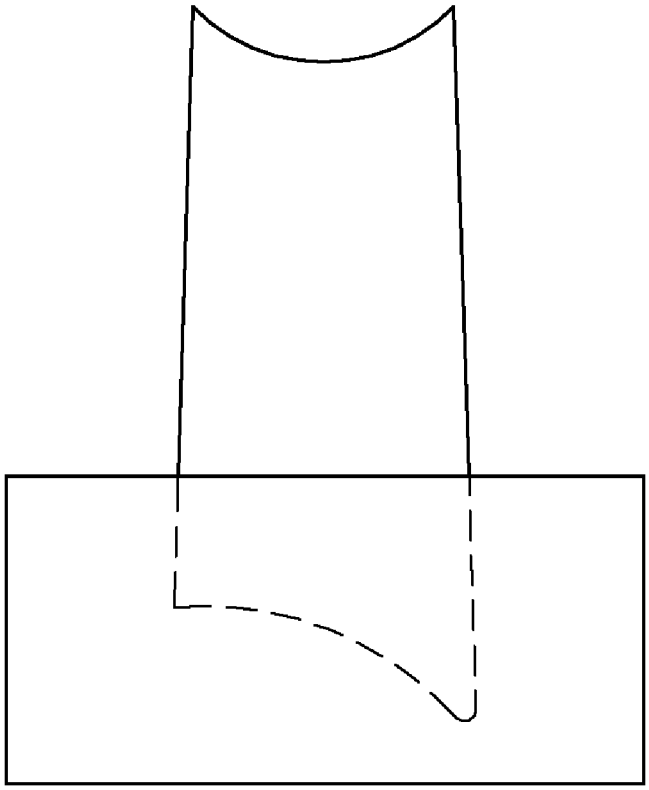

Referring to FIGS. 7-9, a switch apparatus in a third embodiment includes three LED light sources 21 and six pins in the LED housing 20. The LED light sources 21 emit light in red, green, and blue colors correspondingly. A first LED light source is connected between the pin 1 and the pin 4. A second LED light source is connected between the pin 2 and the pin 4. A third LED light source is connected between the pin 3 and the pin 4. The pin 4 is a common pin. The switch is connected between the pin 5 and the pin 6 to light the LED light sources 21. The LED light sources 21 are controlled by PWM to light multiple colors light consisting of red, green, blue colors.

Referring to FIGS. 10-14, in alternative embodiments, different patterns are formed on a top portion of the light guide pole 10 to direct the corresponding functions. For example, power function, decreasing function, adding function, playing function, and so on.

Referring to FIGS. 15-21, in alternative embodiments, heights and shapes of the light guide pole 10 and the LED housing 20 may be changed according to need and/or preference. For example, decrease the height of the light guide pole 10, decrease the height of the LED housing 20, and so on. The light guide pole 10 may be generally transparent, translucent, fogged, or dyed.

It is to be understood, however, that even though numerous characteristics and advantages of the disclosure have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A switch apparatus, comprising:

a light emitting diode (LED) housing defining a pole hole;

at least one LED light source and a switch located inside the LED housing, the switch capable of being triggered to light the at least one LED light source; and a light guide pole extending through the pole hole, and being integral part tapered from a bottom portion inside the LED housing to a top portion outside the LED housing, the light guide pole being capable of transmitting light from the at least one LED light source; the light guide pole movably inserted through the pole hole of the LED housing, wherein the light guide pole is configured to move relative to the LED housing and to press the switch to trigger the at least one LED light source to emit light;

wherein the light guide pole further comprises an oblique dissymmetric curved edge forming a pressing portion located at a bottom end of the oblique dissymmetric curved edge, and the pressing portion abuts the switch.

2. The switch apparatus of claim 1, wherein the LED housing is encapsulated by Dual In-line Package (DIP).

3. The switch apparatus of claim 1, wherein the LED housing is encapsulated by Surface-mount technology (SMT).

4. The switch apparatus of claim 1, wherein the at least one LED light source is located under the light guide pole.

5. The switch apparatus of claim 1, wherein the light guide pole is generally transparent.

6. The switch apparatus of claim 1, wherein the at least one LED light source is located under the oblique dissymmetric curved edge of the light guide pole.

7. The switch apparatus of claim 1, wherein the light guide pole is engaged with the pole hole before the light guide pole pressing the switch.

8. The switch apparatus of claim 1, wherein the switch is a resilient metal piece.

9. The switch apparatus of claim 2, wherein the metal piece is located under the light guide pole.

10. An LED lighting apparatus, comprising:

an LED housing defining a pole hole;

at least one LED light source and a switch located inside the LED housing, the switch being capable of operating the at least one LED light source; and a light guide pole being integral part having a coniform configuration, diameters of the light guide pole gradually increasing from a top portion outside the LED housing to a bottom portion inside the LED housing, the light guide pole being capable of transmitting light from the at least one LED light source; the light guide pole comprising an acute pressing portion protruding towards the switch at the bottom portion of the LED housing, and the acute pressing portion abuts the switch, wherein the light guide pole is configured to move relative to the LED housing and to press the switch to trigger the at least one LED light source to emit light.

11. The LED lighting apparatus of claim 10, wherein the switch is a resilient metal piece.

12. The LED lighting apparatus of claim 10, wherein the LED housing is encapsulated by Dual In-line Package (DIP).

13. The LED lighting apparatus of claim 10, wherein the LED housing is encapsulated by Surface-mount technology (SMT).

14. The LED lighting apparatus of claim 10, wherein the light guide pole is generally transparent.

15. The LED lighting apparatus of claim 10, wherein the light guide pole is generally translucent.

16. The LED lighting apparatus of claim 10, wherein the least one LED light source and the switch are substantially located at a same plane extending along a direction substantially perpendicular to a moving direction of the light guide pole relative to the LED housing.

17. The LED lighting apparatus of claim 10, wherein the LED housing defines a pole hole, and the light guide pole extends through the pole hole, and the light guide pole is engaged with the pole hole before the light guide pole pressing the switch.

18. The LED lighting apparatus of claim 10, wherein the acute pressing portion comprises an oblique dissymmetric curved edge.

19. The LED lighting apparatus of claim 18, wherein the light guide pole defines a recess under the oblique dissymmetric curved edge, the at least one LED light source and the switch are substantially located at a same plane extending along a direction substantially perpendicular to a moving direction of the light guide pole relative to the LED housing, and the least one LED light source is located in the recess.

* * * * *